US010450177B2

(12) United States Patent
Letchworth et al.

(10) Patent No.: US 10,450,177 B2
(45) Date of Patent: Oct. 22, 2019

(54) PRYING TOOL FOR HIGH-VOLTAGE BATTERY PACK

(71) Applicant: Tesla Motors, Inc., Palo Alto, CA (US)

(72) Inventors: Michael Letchworth, Fremont, CA (US); Ruben Aleman, San Mateo, CA (US); Geoff Cutler, Menlo Park, CA (US)

(73) Assignee: TESLA, INC., Palo Alto, CA (US)

( * ) Notice: Subject to any disclaimer, the term of this patent is extended or adjusted under 35 U.S.C. 154(b) by 622 days.

(21) Appl. No.: 15/068,579

(22) Filed: Mar. 12, 2016

(65) Prior Publication Data

US 2017/0260034 A1 Sep. 14, 2017

(51) Int. Cl.
*B66F 15/00* (2006.01)
*B25G 1/12* (2006.01)

(52) U.S. Cl.
CPC ..... *B66F 15/00* (2013.01); *B25G 1/12* (2013.01); *Y10T 29/539* (2015.01); *Y10T 29/53896* (2015.01)

(58) Field of Classification Search
CPC ..... B66F 15/00; B66F 13/005; B25G 1/12; B25G 3/38
See application file for complete search history.

(56) References Cited

U.S. PATENT DOCUMENTS

| | | | | |
|---|---|---|---|---|
| 8,277,965 | B2 | 10/2012 | Hermann et al. | |
| 8,833,499 | B2 | 9/2014 | Rawlinson | |
| 2010/0084799 | A1* | 4/2010 | Wong | B25B 5/085 269/214 |
| 2013/0099184 | A1* | 4/2013 | McNeill | E04H 17/263 254/30 |

* cited by examiner

*Primary Examiner* — Peter Dungba Vo
*Assistant Examiner* — Joshua D Anderson
(74) *Attorney, Agent, or Firm* — Garlick & Markison; Bruce E. Garlick

(57) ABSTRACT

A prying tool comprises: a pry bar comprising a load tip at a distal end and a handle at a proximate end, the pry bar having a pair of pins extending on opposing sides thereof; a body through which the pry bar extends, the body forming a pair of pivot points for the respective pins, and a slot extending away from each of the pivot points; and a clamp that is attached to the body and configured for securing the prying tool by clamping a base of the body to a surface.

12 Claims, 2 Drawing Sheets

PRYING TOOL FOR HIGH-VOLTAGE BATTERY PACK

BACKGROUND

Mechanical tools are used for opening covers and other structures in a variety of contexts. One such area involves electric or electronic systems or components, where particular care should be taken to ensure safety of the operator and the equipment. For example, some energy storage systems are based on electrochemical cells (e.g., of the lithium ion type) that are controlled using electronic circuitry such as battery management systems and other circuit boards with components. For this reason, the use of metal tools to manipulate the housing of such a system can increase the likelihood of inadvertently contacting live electrical terminals, damaging sensitive components, or deteriorating a sealing quality of the housing.

SUMMARY

In a first aspect, a prying tool comprises: a pry bar comprising a load tip at a distal end and a handle at a proximate end, the pry bar having a pair of pins extending on opposing sides thereof; a body through which the pry bar extends, the body forming a pair of pivot points for the respective pins, and a slot extending away from each of the pivot points; and a clamp that is attached to the body and configured for securing the prying tool by clamping a base of the body to a surface.

Implementations can include any or all of the following features. The handle is electrically isolated from the load tip. The pry bar has an angle so that the load tip is angled relative to the handle. The pins are located approximately at the angle. The body comprises a member having essentially a U-profile, and wherein the body is configured so the pry bar is positioned between respective legs of the U-profile. The prying tool further comprises a containment member that forms at least corresponding ends of the slots opposite the respective pivot points. The containment member forms parts of the respective slots in addition to the respective corresponding ends. The containment member also has essentially a U-profile, the U-profile of the containment member oriented oppositely to the U-profile of the body. The body forms essentially an L-shape. The pivot points and the slots are positioned on one leg of the L-shape, and wherein the clamp is attached on another leg of the L-shape. The L-shape is formed by a member having essentially a U-profile. The prying tool further comprises a bar at a proximate end of the body, the bar joining respective legs of the U-profile to each other to prevent the pry bar from entering. The L-shape has a rounded portion facing inward that joins respective legs of the L-shape to each other. The prying tool further comprises a protective member on the base of the body. The clamp is a ratchet clamp.

In a second aspect, a prying tool comprises: a pry bar; a body through which the pry bar extends; a clamp that is attached to the body and configured for clamping a base of the body to a surface of an object; first means for preventing the pry bar from being inserted more than a predefined distance into the object when separating a cover from the object; and second means for preventing the pry bar from exerting force onto the object in a direction away from the cover.

Implementations can include any or all of the following features. The first means comprises a pair of pins extending on opposing sides of the pry bar, the pins rotatably connected to the body, wherein the body has a front surface configured to bear against a side of the object when separating the cover from the object. The second means comprises a pair of pins extending on opposing sides of the pry bar, the pins rotatably connected to the body and confined to move within slots on the body, wherein first ends of the slots form pivot points for the pins.

DETAILED DESCRIPTION

This document describes examples of devices and techniques for use in opening of lids and other structures where a prying mechanism is used. Some implementations involve prying open a lid or other cover of a housing for a of lithium ion battery system. Such housings and their electrochemical cells are sometimes referred to as battery packs. For example, some battery packs have a generally flat configuration consisting of a base covered by a lid. The base can include a wide floor surface surrounded on all sides by low walls. The lithium ion cells and related electronic components, as well as conductors and a cooling system, etc., are assembled into the shallow base which is finally closed by affixing a lid to the top of the walls to create an enclosure. To service the battery pack, the lid must typically be removed. This can necessitate prying the lid loose from the top surface of the wall where it is attached. As another example, some battery packs include one or more cross members on its inside and once the cover is removed, it may be necessary to lift such a cross member by way of a prying action. The present disclosure therefore describes examples of prying tools having a pry bar and a fulcrum that reduce the risk of electric contact or for damage to the equipment.

Figure 1:
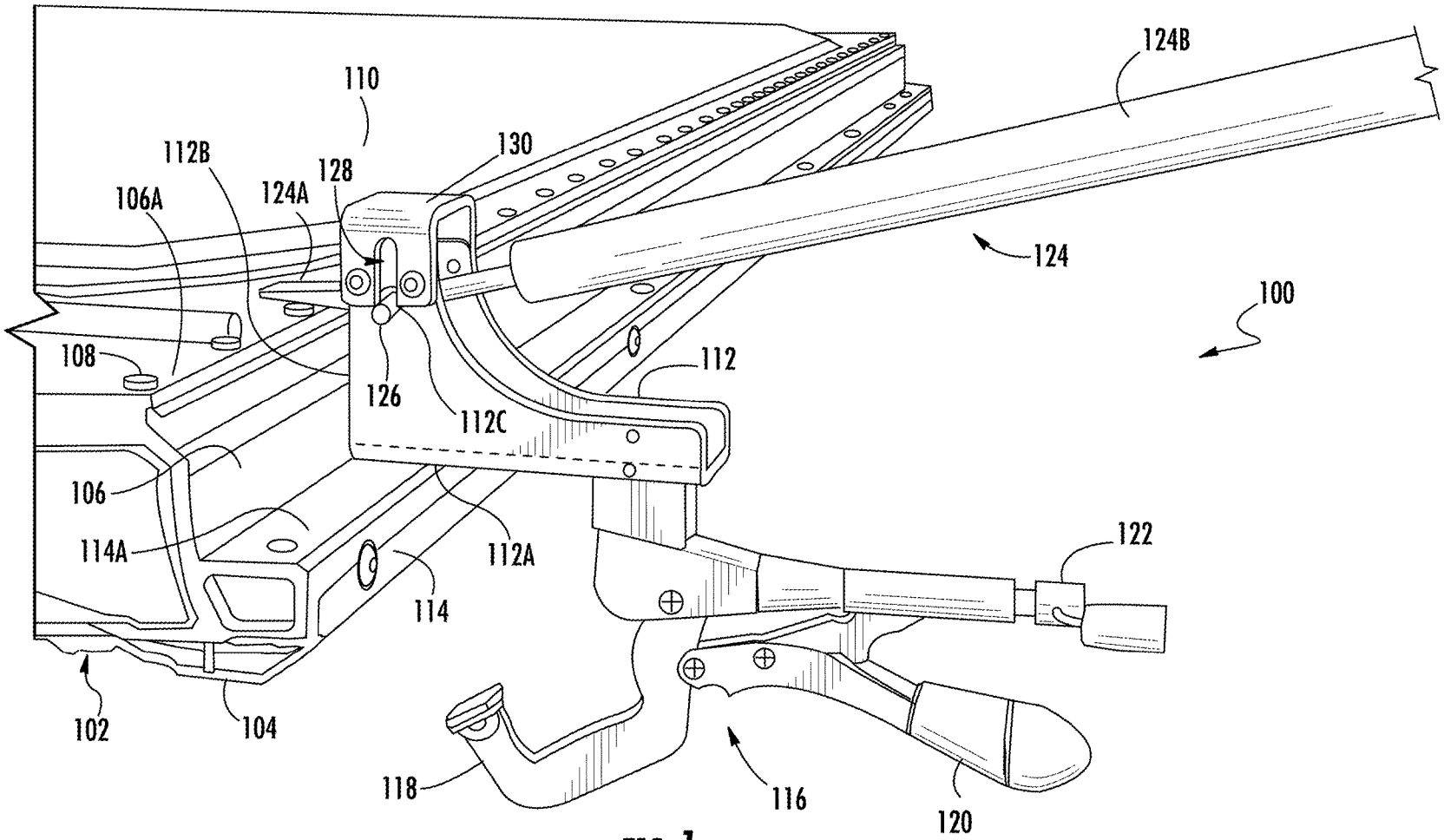
FIG. 1 shows an example of a prying tool.

FIG. 1 shows an example of a prying tool 100. The tool is here shown attached to a battery pack 102, which can include electrochemical batteries such as lithium ion cells. The battery pack consists of a floor 104 that is surrounded by walls 106 having a top surface 106A. On the top surface, fastening mechanisms 108 (e.g., rivet nuts with bolts) are used for attaching a cover 110 to the battery pack. The cover can also or instead be attached using another approach, including, but not limited to, an adhesive.

The tool 100 can be used for prying the cover 110 loose from the battery pack 102. The tool here includes a body 112 that is configured to fit against the side of the battery pack. In particular, the pack here has an edge 114 at its bottom that is wider than the rest of the pack, and this edge forms a surface 114A that in this example faces upward and is oriented at an angle to the wall 106. The body 112, moreover, has a base surface 112A that can bear against the surface 114A, and a front surface 112B that can bear against the wall 106.

The prying tool 100 here has a clamp 116 attached to the body 112. The clamp is configured for attaching the tool to another object, such as to the battery pack 102 in this example. The clamp has a jaw 118 that can be actuated using a handle 120 and an adjustment mechanism 122. As such, the jaw can selectively be closed so as to press the body against the edge 114. For example, the clamp can be a ratchet clamp.

The prying tool 100 here has a pry bar 124 attached to the body 112. The pry bar can be made of metal and here includes a load tip 124A at one end and a handle 124B at another end. The load tip is configured for being fitted in between (in this example) the cover 110 and the surface 106A of the wall 106 so as to perform prying. A user applies force using the handle. In this example, the pry bar is angled so that the load tip is positioned at an angle relative to the handle. Other implementations can have a different angle or no angle, to name just two examples. Here, the handle is electrically isolated, for example by applying an electrically isolating material around the metal body of the pry bar.

The pry bar 124 has a pair of pins 126, each of which extends from one of the sides of the pry bar in opposite directions to form a fulcrum. Therefore, the pry bar is pivotally mounted relative to the body 112. For example, on each side of the body a respective pivot point 112C can be formed, so that when force is applied, the pry bar pivots about the pivot points. In some implementations, the pins can be located approximately at a point where the pry bar is angled.

It was mentioned earlier that the body of the prying tool is secured relative to the battery pack using the clamp. The attachment of the pry bar to the body, moreover, serves to reduce the likelihood that the pry bar is inadvertently inserted deeper into the battery pack than necessary. For example, the attachment can prevent insertion deeper than what is illustrated in the figure. That is, if one were to use a traditional pry bar that is held by hand, then the application of force on the bar against the gap between the cover and the wall of the battery pack could inadvertently result in the pry bar slipping deeper into the battery pack. Examples described in the present disclosure, however, can reduce this likelihood by restricting the pry bar using the pivotal attachment to the body. As such, the pins 126 that interact with the body 112 can serve to prevent the pry bar from being inserted more than a predefined distance into the battery pack in the process of separating the cover therefrom.

Each of the pins 126 is located inside a corresponding slot 128 on the body. The slots allow the pins and thereby the pry bar to be moved in a certain way relative to the body of the tool. For example, the pins can be positioned at the pivot points 112C (i.e., at the end of the respective slots) when force is applied to the handle so as to pry the cover upward with the load tip of the pry bar. On the other hand, if the load tip were placed against the top surface 106A of the wall, and the user instead raised the handle, then the slots would allow the pins to be moved away from the pivot points, in this example upward in the respective slots. The result is that the prying tool cannot inadvertently apply downward pressure on the load tip so as to damage the top surface 106A or interior components of the battery pack. As such, the arrangement that involves the pins being moveable within the slots can serve to prevent the pry bar from exerting force onto the battery pack in a direction away from the cover.

In short, the above is an example of the prying tool 100 including the pry bar 124 that has the load tip 124A at a distal end and the handle 124B at a proximate end. The pry bar has the pins 126 extending on opposing sides thereof. The prying tool also includes the body 112 through which the pry bar extends, this body forming the pivot points 112C for the respective pins. The body also has the slots 128 extending away from each of the pivot points. Moreover, the prying tool includes the clamp 116 that is attached to the body and configured for securing the prying tool by clamping the base surface 112A of the body to the surface 114A of the edge 114. For example, the pins 126 can extend on opposing sides of the pry bar and can be rotatably connected to the body 112, wherein the body has the front surface 112B that bears against the wall 106 of the battery pack 102 when separating the cover 110 therefrom. As another example, the pins can be confined to move within the slots 128, wherein the pivot points 126 for the pins are formed at one end of the respective slot.

The prying tool 100 can have a containment member 130 on the body 112. In some implementations, the containment member forms at least corresponding ends of the slots 128, these ends being opposite the respective pivot points 126. For example, the slot 128 can be formed entirely in the body 112 and extend to the edge thereof, and the containment member can then close off this edge opening so as to form the other end of the slot. In other implementations, such as the present example, the containment member has slots on its respective opposing sides. When the containment member is attached to the rest of the body, these slots match with the slots formed in the body so as to form completed slots that enclose the pins.

The body 112 can be made of any suitable material, such as metal. In some implementations, the body has essentially a U-profile when viewed along the pry bar. For example, the body can be formed from a steel plate that is bent so that a bottom of the U-shape forms the base surface 112A and so that the parallel legs of the U-shape form the structure where the slots 128 and the pivot points 126 can be created. As such, the pry bar can be positioned between respective legs of the U-profile. The containment member 130 can be made of any suitable material, such as metal. In some implementations, the containment member has essentially a U-profile when viewed along the pry bar. For example, the U-profile of the containment member can be oriented oppositely to the U-profile of the body so as to form continuous slots for the pins on the pry bar.

Figure 2:
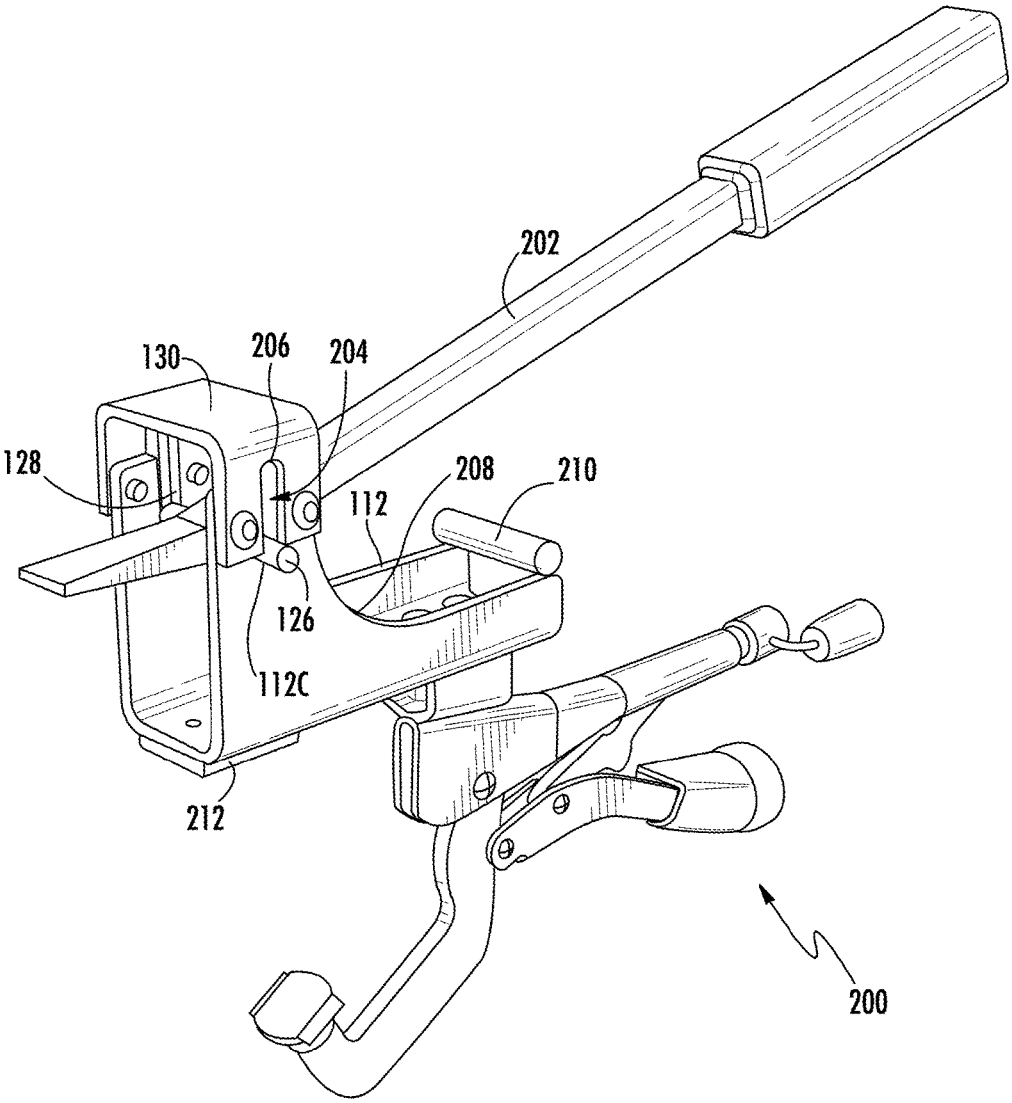
FIG. 2 shows another example of a prying tool.

FIG. 2 shows another example of a prying tool 200. A number of aspects of the tool 200 are identical or similar to those of the tool 100 (FIG. 1) and some of those will not be addressed in detail in the following. Generally, the prying tool 200 can be used for prying one object with regard to another, such as to remove a cover from a housing, or to lift a member from an enclosure. The tool here has a pry bar 202 that is attached to the body 112 by way of a fulcrum. In particular, the body forms the slots 128 that extend to the top of the body, and these correspond to respective slots 204 that are formed in the containment member 130. Accordingly, each of the pins 126 can be moved within the slots 128/204 between the pivot points 112C and upper slot ends 206 formed in the containment member 130.

When viewed in a direction parallel with the pins 126, the body 112 can have a form that is essentially an L-shape. In some implementations, one leg of the L-shape can be formed by the base surface that is to be clamped to secure the tool (in this example, the longer of the legs), and another leg can be formed by the part of the body where the slots and the pivot points are located (in this example, the shorter of the legs). For example, here the L-shape is formed by an originally flat metal member having a shape such that when it is folded into the U-shape that was mentioned above, it also creates the L-shape described here. The body can have one or more inward facing rounded portions 208 that joins respective legs of such an L-shape.

A bar 210 is here formed on the body 112. In some implementations, the bar joins the respective legs of a U-profile to each other, here towards the proximate end of the body. For example, this can prevent the pry bar from entering the gap between these sides.

A protective member 212 can be provided on a base surface of the body 112. For example, this member can enhance the clamping of the tool to a surface and/or can protect that surface from damage due to the clamping.

A number of implementations have been described as examples. Nevertheless, other implementations are covered by the following claims.

What is claimed is:

1. A prying tool comprising:

a pry bar comprising a load tip at a distal end and a handle at a proximate end, the pry bar having a pair of pins extending on opposing sides thereof;

a body through which the pry bar extends, the body forming a pair of pivot points for respective pins of the pair of pins, and a slot extending away from each of the pivot points, the body further including a member having a U-profile, and configured so the pry bar is positioned between respective legs of the U-profile;

a clamp that is attached to the body and configured for securing the prying tool by clamping a base of the body to a surface; and a containment member that forms at least corresponding ends of the slots opposite the respective pivot points, and wherein the containment member also has a U-profile, the U-profile of the containment member oriented oppositely to the U-profile of the body.

2. The prying tool of claim 1, wherein the body forms an L-shape.

3. The prying tool of claim 2, wherein the pivot points and the slots are positioned on one leg of the L-shape, and wherein the clamp is attached on another leg of the L-shape.

4. The prying tool of claim 3, wherein the L-shape is formed by the member having a U-profile.

5. The prying tool of claim 4, further comprising a bar at a proximate end of the body, the bar joining respective legs of the U-profile of the member to each other to prevent the pry bar from entering a gap between the respective legs of the U-profile of the member.

6. The prying tool of claim 2, wherein the L-shape has a rounded portion facing inward that joins respective legs of the L-shape to each other.

7. The prying tool of claim 1, further comprising a protective member on the base of the body.

8. The prying tool of claim 1, wherein the clamp is a locking clamp.

9. The prying tool of claim 1, wherein the handle is electrically isolated from the load tip.

10. The prying tool of claim 1, wherein the pry bar has an angle so that the load tip is angled relative to the handle.

11. The prying tool of claim 10, wherein the pins are located proximate to the angle.

12. The prying tool of claim 1, wherein the containment member forms parts of respective slots in addition to respective corresponding ends.

* * * * *